US005989796A

United States Patent [19]

Moon

[11] Patent Number: 5,989,796

[45] Date of Patent: Nov. 23, 1999

[54] ORGANIC SILVER SALT CONTAINING THERMALLY PROCESSABLE ELEMENTS WITH SPOT REDUCING SURFACTANT COMBINATIONS

[75] Inventor: Alice Moon, Penfield, N.Y.

[73] Assignee: Eastman Kodak Company, Rochester, N.Y.

[21] Appl. No.: 09/165,885

[22] Filed: Sep. 30, 1998

[51] Int. Cl.[6] ..... G03C 1/498; G03C 1/49; G03C 1/76

[52] U.S. Cl. ..... 430/536; 430/523; 430/531; 430/539; 430/637; 430/636; 430/961; 430/964

[58] Field of Search ..... 430/523, 531, 430/536, 539, 631, 636, 637, 638, 961, 964

[56] References Cited

U.S. PATENT DOCUMENTS

| | | | |
|---|---|---|---|
| 3,080,254 | 3/1963 | Grant, Jr. | 430/474 |
| 4,367,283 | 1/1983 | Nakayama et al. | 430/636 |
| 4,741,992 | 5/1988 | Przezdziecki | 430/523 |
| 5,198,406 | 3/1993 | Mack et al. | 503/207 |
| 5,380,644 | 1/1995 | Yonkoski et al. | 430/617 |
| 5,503,967 | 4/1996 | Furlan et al. | 430/637 |
| 5,545,507 | 8/1996 | Simpson et al. | 430/617 |
| 5,571,665 | 11/1996 | Ballerini et al. | 430/637 |
| 5,635,339 | 6/1997 | Murray | 430/617 |
| 5,654,130 | 8/1997 | Murray | 430/617 |
| 5,686,228 | 11/1997 | Murray et al. | 430/617 |
| 5,736,293 | 4/1998 | Hirai et al. | 430/203 |

OTHER PUBLICATIONS

Research Disclosure, vol. 170, Jun. 1978, Item 17029.
Research Disclosure, vol. 389, Sep. 1996, Item 38957.

*Primary Examiner*—Richard L. Schilling
*Attorney, Agent, or Firm*—Carl O. Thomas

[57] ABSTRACT

A thermally processable imaging element is disclosed having a protective coat overlying at least one thermographic or photothermographic imaging layer containing an organic silver salt and a thermally activated reducing agent for silver ion. The protective coat includes a film-forming binder comprised of a water dispersible polymer containing hydroxy pendant groups and, to reduce low density spots visible after thermal processing, a combination of anionic, non-ionic and fluorocarbon moiety containing surfactants satisfying formula defined selection criteria.

10 Claims, No Drawings

ORGANIC SILVER SALT CONTAINING THERMALLY PROCESSABLE ELEMENTS WITH SPOT REDUCING SURFACTANT COMBINATIONS

FIELD OF THE INVENTION

This invention relates to thermally processable imaging elements. The invention relates more particularly to thermographic and photothermographic elements containing an organic silver salt as a silver ion source for image formation.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. By far the most common imaging compositions included in thermally processable elements are those that contain an organic silver salt to provide a source of silver ion relied upon for image formation and a thermally activated reducing agent for the silver ion. The silver ion can form a metallic silver image when reduced (as is usually practiced in forming black-and-white images) and/or the thermally activated reducing agent when oxidized in the oxidation-reduction reaction can form a dye image (as is usually practiced in forming color images). A summary of these common types of photothermographic element constructions is provided by *Research Disclosure*, Vol. 170, June 1978, Item No. 17029. *Research Disclosure* is published by Kenneth Mason Publications, Ltd., Dudley House, 12 North St., Emsworth, Hampshire P010 7DQ, England. Many of these photothermographic element constructions are also useful as thermographic elements. Most photothermographic elements that rely on photosensitive silver halide to catalyze an image-forming oxidation-reduction reaction can be used as thermographic elements. When use exclusively as a thermographic element is contemplated, a common modification is to omit the photosensitive silver halide and to rely on the imagewise application of heat to drive the image-forming oxidation-reduction reaction, as illustrated by Grant U.S. Pat. No. 3,080,254.

It is common practice to include a protective coating overlying the imaging layer(s) in the construction of a thermally processable element. In addition to the variety of functions that protective coatings are recognized to perform in imaging elements generally, such as adhesion to the underlying portion (i.e., layer or support) of the element, optical transparency as required (including resistance to fingerprints and scratches), low transport friction, low self-adhesion (necessary for use of spool wound or stacked sheet elements), and sensitometric compatibility with the imaging layers, the protective coatings of thermally processed elements are also commonly relied upon to resist deformation during thermal processing and to reduce or prevent loss of volatile components during thermal processing. Also, unlike imaging elements that rely on penetration by aqueous processing solutions, the protective coatings of thermally processable elements need not be water permeable and often serve their purpose better when relatively impermeable. In thermally processable elements imaging layer protective overcoats are often referred to as barrier layers. As a result of differing functional requirements, most conventional selections of protective coatings for thermally processable elements have taken specialized forms unsuited for imaging elements generally.

*Research Disclosure*, Item No. 17029, cited above, XI. Overcoat Layers, catalogues known overcoat components of photothermographic elements. Surfactants are specifically addressed in section X. Coating Aids. The term "surfactant", a condensation of the phrase "surface active agent", designates a compound that contains a hydrophilic moiety and a hydrophobic moiety. Surfactant 10G™, available from Olin Co., a non-ionic surfactant, is specifically identified in Item 17029. Przezdziecki U.S. Pat. No. 4,741,992, assigned to Eastman Kodak Co., discloses the use of Surfactant 10G™ in the overcoat of a thermally processable element.

Surfactants containing a fluorocarbon hydrophobic moiety have been used in the overcoat of thermally processable elements. For example, Mack et al U.S. Pat. No. 5,198,406, assigned at issue to Polaroid Corp., discloses the overcoat incorporation of Zonyl FSN™, available from DuPont.

Hirai et al U.S. Pat. No. 5,736,293, assigned at issue to Fuji Photo Film Co., discloses photothermographic elements having a protective coat containing the following surfactants:

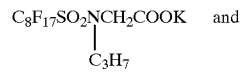

(1)

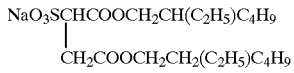

(2)

This surfactant combination appears in numerous protective coat formulations disclosed in patents assigned at issue to Fuji Photo Film Co.

Yonkoski et al U.S. Pat. No. 5,380,644, Simpson et al U.S. Pat. No. 5,545,507, and Murray (et al) U.S. Pat. Nos. 5,635,339, 5,654,130 and 5,686,228, assigned at issue to Minnesota Mining and Manufacturing Co. (a.k.a. 3M) or Imation Corp. (a company formed by 3M to continue this line of business), disclose varied protective coats for thermally processable elements. Only Yonkoski et al identifies any protective coat component, a linear polymer with a pendant fluorocarbon moiety, as being a surfactant. Yonkoski et al includes the surfactant to control surface anomalies—specifically mottle. The term "mottle", not defined by Yonkoski et al, is generally employed in the imaging arts to designate image noise significantly in excess of that attributable to granularity. Simpson et al and Murray (et al) demonstrate that surfactants are not essential surface coating components and are, in fact, often omitted entirely where other components permit.

An extensive listing of surfactants for use in photographic elements is contained in *Research Disclosure*, Vol. 389, September 1996, Item 38957, IX. Coating physical property modifying addenda, A. Coating aids.

PROBLEM TO BE SOLVED

When thermally processable elements rely on an organic silver salt as a source of silver ions for image formation, it has been observed that, following imagewise exposure and thermal processing, an apparently random pattern of spots of lower density are observable with the unaided eye. The highest incidents of these low density spots ranges from the threshold of visibility (<1 mm) up to 2 mm. Even though spots of larger sizes are fewer in number, their increased size renders them conspicuous and objectionable, when present.

SUMMARY OF THE INVENTION

In one aspect, this invention is directed to a thermally processable imaging element, said element being comprised of (a) a support; (b) at least one thermographic or photothermographic imaging layer coated on the support containing an organic silver salt capable of releasing silver ion and a thermally activated reducing agent for silver ion; and (c) a protective coat overlying the imaging layer including a film-forming binder comprised of a water dispersible polymer containing hydroxy pendant groups; wherein, to reduce low density spots visible after thermal processing, a combination of the following surfactants are included in the protective coating:

(I) $(R^1)_z$—Ar—[O—$(R^2)_w$—(L) $_x]_y$—$X^-M^+$ (II) $(R^1)_z$—Ar—O—$(R^2)_v$—H and (III) $R^f$—[$SO_2N(R^3)]_t(R^2)_u$—H wherein $R^1$ is a saturated hydrocarbon containing from 1 to 20 carbon atoms;

z is 1 to 3;

Ar is a divalent aromatic group containing from 6 to 14 carbon atoms;

L is a divalent hydrocarbon linking group containing up to 5 carbon atoms;

x is zero or 1;

y is zero or 1;

$X^-$ is —$SO_3^{-1}$ or —$SO_4^{-1}$;

$M^+$ is an alkali metal or ammonium cation;

$R^2$ a divalent hydrophilic alkoxy group;

w is zero to 20;

v is 3 to 20;

u is 4 to 24;

$R^3$ is hydrogen or an alkyl group of from 1 to 5 carbon atoms;

t is zero or 1;

$R^f$ is a fluorocarbon group containing from 4 to 24 carbon atoms;

compound (I) accounts for from 30 to 75 percent of the total weight of compounds (I), (II) and (III);

compound (II) accounts for from 15 to 50 percent of the total weight of compounds (I), (II) and (III); and compound (III) accounts for from 4 to 40 percent of the total weight of compounds (I), (II) and (III).

It has been discovered quite surprisingly that superior low density spot reduction is realized when surfactants (I), (II) and (III) are employed in combination in the proportions indicated than when any one class of the surfactants is employed alone or any two classes of the surfactants are employed in combination.

DETAILED DESCRIPTION OF THE INVENTION

The present invention is directed to the modification of protective coat formulations overlying the imaging layer of a thermally processable imaging element to reduce the incidence of visible low density spots following imagewise exposure and processing. The thermally processable imaging elements that are benefited by the protective coat modifications of this invention are those that employ (1) in an imaging layer, an organic silver compound capable of releasing silver ion for image formation and (2) in a protective coat overlying the imaging layer, a film-forming binder comprised of a water dispersible polymer containing hydroxy pendant groups. Specifically, a large reduction in visible minimum density spots (and in some instances elimination of visible minimum density spots) has been discovered to flow from a combination of surfactants from three classes and in proportions specifically identified below.

The three surfactant classes are anionic surfactants (hereinafter referred to as Class 1 or C-1 surfactants), non-ionic surfactants lacking a fluorocarbon moiety (hereinafter referred to as Class 2 or C-2 surfactants), and surfactants containing a fluorocarbon moiety (hereinafter referred to as Class 3 or C-3 surfactants). Within Class 1 the anionic surfactants contemplated for use in combination in the protective coat are those satisfying the following formula:

$$(R^1)_z—Ar—[O—(R^2)_w—(L)_x]_y—X^-M^+. \quad (I)$$

Within Class 2 the non-ionic surfactants contemplated for use in combination in the protective coat are those satisfying the following formula:

$$(R^1)_z—Ar—O—(R^2)_v—H. \quad (II)$$

Within Class 3 the fluorocarbon moiety containing surfactants contemplated for use in combination in the protective coat are those satisfying the following formula:

$$R^f—[SO_2N(R^3)]_t(R^2)_u—H. \quad (III)$$

The function of $(R^1)_z$— is to provide the hydrophobic moiety of the formulae (I) and (II) surfactants in which it is contained. $R^1$ is a saturated hydrocarbon containing from 1 to 20 carbons atoms, preferably from 2 to 10 carbons, and optimally from 3 to 8 carbon atoms. z is the integer 1, 2 or 3. $R^1$ and z are independently selected in the formulae (I) and (II) compounds. $R^1$ and z are preferably chosen to provide hydrophobicity without excessively increasing the bulk of the surfactants. For example, when z is 3, $R^1$ can contain only one 1 carbon atom, but preferably does not exceed 8 carbon atoms. When z is 1, it is preferred that $R^1$ contain at least 3 carbon atoms.

$R^1$ is required to be a saturated hydrocarbon. The term "hydrocarbon" is used in its chemically recognized sense as extending to moieties that contain only hydrogen and carbon atoms. The term "saturated" is used to indicate the presence of only highly stable carbon-to-carbon bonds, such as those found in aliphatic compounds having only single carbon-to-carbon bonds and in compounds having carbon-to-carbon bonds found in aromatic rings. Hydrocarbons having aliphatic carbon-to-carbon double bonds and carbon-to-carbon triple bonds are excluded by the "saturated" requirement. Stated in an alternative quantitative way, the saturated hydrocarbon moieties contemplated to form $R^1$ have carbon-to-carbon bond lengths of $\geqq$1.39 Angstroms, which are the accepted carbon-to-carbon bond lengths of benzene. By comparison the carbon-to-carbon bond lengths of alkanes are in the vicinity of 1.50 Angstroms while the carbon-to-carbon bond lengths of alkene carbon-to-carbon double bonds is 1.34 Angstroms.

Ar is an aromatic group containing 6 to 14 carbon atoms. Preferably Ar is an aromatic hydrocarbon, such as phenyl or naphthyl. As demonstrated in the Examples below, the omission of an aromatic moiety (e.g., replacement with a comparable aliphatic moiety) results in protective coatings that are inferior in spot reduction to those satisfying the surfactant requirements of this invention. Ar can be independently selected in formulae (I) and (II).

In formula (III) the hydrophobic moiety of the surfactant is provided by the fluorocarbon group $R^f$, which contains from 4 to 24 carbon atoms, preferably from 6 to 20 carbon atoms. $R^f$ can be viewed as a hydrocarbon that has had its hydrophobicity increased by substitution of fluorine for hydrogen. Replacement of all hydrogen with fluorine achieves the highest hydrophobicity with minimal bulk. Perfluoroalkyl groups (i.e., $C_nF_{2n+1}$—, where n is the number of carbon atoms noted above) are generally preferred.

The components of the surfactants above in addition to $R^1$, Ar and $R^f$ are present to provide the hydrophilic moiety of each surfactant.

$R^2$ is a hydrophilic alkoxy group. In the simplest contemplated form $R^2$ is —$C_nH_{2n}O$—, where n is 2. When n is greater than 2, one or more of the hydrogen is replaced with a hydrophilic substituent to maintain the required hydrophilicity. Hydrophilic substituents, such as hydroxy, hydroxymethyl and hydroxyethyl can be chosen. Preferably the hydrophilic alkoxy group (including hydrophilic substituents, if any) contains 5 or fewer carbon atoms.

In formula (I) the moiety $R^2$ can be repeated in the linkage up to 20 times (w=20). In preferred forms w is in the range of from 2 to 10. However, the moiety $R^2$ is not essential to imparting hydrophilic properties (i.e., w can equal zero), since the anionic group $X^-$ can alone (i.e., y is zero) be an adequate hydrophilic moiety. In synthetically convenient forms X_ can be a sulfo (—$SO_3^-$) or sulfato (—$SO_4^-$) group. As added to the coating formulation, $M^+$ is an alkali metal or ammonium group. However, it is appreciated that $M^+$ is dissociated in the coating formulation, which can contain cations from other sources.

In most surfactants a divalent saturated hydrocarbon linking group L containing from 1 to 5, most typically 1 to 3, carbon atoms is included as a synthetic convenience. However the linking group is not required; hence x can be zero or 1.

As noted above, y can be zero; but y is 1 when either or both of $R^2$ and L are present in the surfactant of formula (I).

In the formula (II) surfactant $R^2$ alone forms the hydrophilic moiety of the surfactant and is an essential component. v is at least 3 and can range to 20. Preferably v is 6 to 16 and optimally 8 to 14.

In the formula (III) surfactant $R^2$ optionally together with the sulfonamido group (i.e., t=zero or 1) forms the hydrophilic moiety of the surfactant and is an essential component. u is at least 4 (to compensate for the higher minimum level of hydrophobicity of $R^f$— as compared $(R^1)_z$—Ar—) and can range to 24. Preferably u is 6 to 16 and optimally 8 to 14.

$R^3$ is hydrogen or an alkyl group containing from 1 to 5 carbon atoms.

Oxy (—O—) linkages are present in each of the Class 1, 2 and 3 surfactants; however, it is appreciated that oxygen to oxygen bonds are unstable and are therefore not present in any of surfactants.

For reduced spotting it is necessary that the protective coat contain each of the Class 1, Class 2 and Class 3 surfactants of formulae (I), (II) and (III) class. Additionally, the proportions of the Class 1, 2 and 3 surfactants must be maintained within prescribed ranges. The Class 1 surfactant (s) of formula (I) accounts for from 30 to 75 (preferably 40 to 65) percent of the total combined surfactants of Classes 1, 2 and 3. The Class 2 surfactant(s) of formula (II) accounts for from 15 to 50 (preferably 20 to 35) percent of the total combined surfactants of Classes 1, 2 and 3. The Class 3 surfactant(s) of formula (III) accounts for from 4 to 40 (preferably 10 to 30) percent of the total combined surfactants of Classes 1, 2 and 3.

The amounts of the Class 1, 2 and 3 surfactants present in the protective coating can be varied widely, provided their relative proportions are maintained in the ranges described above. Conventionally overcoat surfactants in a protective coat overlying an imaging layer account for less than 15 (more typically, less than 10) percent of the total weight of the protective coat with common selections of optional addenda present. The surfactant combinations here contemplated do not require higher than conventional overall levels of surfactants, based on the weight of the protective coat. The protective coat surfactants when present in conventional levels can perform conventional surfactant functions in addition to the low density spot reduction function, the discovery of this invention. The low density spot reducing surfactant concentrations are most appropriately referenced to the total weight of the protective coat. It is generally preferred that the Class 1 surfactant in the protective coat account for from 0.5 to 10 (preferably 1 to 6) percent by weight, based on the total weight of the protective coat. From the Class 1 surfactant coating ranges and the proportions set out above, coating coverages of the Class 2 and Class 3 surfactants can be calculated. For example, at the lowest Class 1 surfactant coverage, the highest permissible proportion of the Class 2 surfactant is 0.83 percent by weight, based on the total weight of the protective coat, and the highest permissible proportion of the Class 3 surfactant is 0.67 percent by weight, based on the total weight of the protective coat. At the highest Class 1 surfactant coverage, the lowest permissible proportion of the Class 2 surfactant is 2.0 percent by weight, based on the total weight of the protective coat, and the lowest permissible proportion of the Class 3 surfactant is 0.53 percent by weight, based on the total weight of the protective coat.

The simplest contemplated thermally processable element construction satisfying the requirements of the invention is illustrated by the following:

| Element A |
|---|
| Overcoat Unit<br>Imaging Layer Unit<br>Support |

wherein the Overcoat Unit consists of the protective coat described above overlying the Imaging Layer Unit and forming a surface coating over one major surface of Element A. Alternatively, the protective coat can be one of two or more coatings forming the Overcoat Unit. When the Overcoat Unit contains two or more layers, the remaining layer or layers overlie the protective coat so that the protective coat remains in contact with the Imaging Layer Unit.

Typically additional, optional conventional element components are present as illustrated by the following:

| Element B |
|---|
| Overcoat Unit<br>Imaging Layer Unit<br>Support<br>Surface Coating |

The Surface Coating, in each occurrence, can be constructed in any conventional manner or identically to the Overcoat Unit, but with the recognition that it performs no low density spot reduction function because of its location. Although the Surface Coating can additionally act as an antihalation and/or anticurl layer, if desired, it is usually preferred to incorporate a separate antihalation and/or anticurl layer, as illustrated by the following elements:

| Element C |
|---|
| Overcoat Unit<br>Imaging Layer Unit<br>Antihalation Layer<br>Support<br>Surface Coating |
| **Element D** |
| Overcoat Unit<br>Imaging Layer Unit<br>Antihalation Layer<br>Support<br>Anticurl Layer<br>Surface Coating |
| **Element E** |
| Overcoat Unit<br>Imaging Layer Unit<br>Support<br>Anti-Curl/Antihalation Layer<br>Surface Coating |

The Overcoat Unit contains a film-forming binder comprised of a water dispersible polymer containing hydroxy pendant groups. Typical polymers contemplated for use as film-forming binders include natural polymers containing hydroxy pendant groups, such as gelatin and gelatin derivatives, starch and polymers, such as poly(vinyl alcohol). Gelatin, gelatin-derivatives and art recognized alternative hydrophilic film-forming binders are summarized in *Research Disclosure*, Item 38957, II. Vehicles, vehicle extenders, vehicle-like addenda and vehicle related addenda, A. Gelatin and hydrophilic colloid peptizers and B. Hardeners. Gelatin, when employed as a film-forming binder, can take the form of alkali-treated gelatin (e.g., cattle bone or hide gelatin) or acid-treated gelatin (e.g., pigskin gelatin) and their derivatives—e.g., acetylated or phthalated gelatin. Cellulose esters, such as cellulose acetate, cellulose butyrate or cellulose acetate butyrate, are specifically contemplated.

The film-forming binder is coated in each layer of the Overcoat Unit at any convenient level sufficient to insure uniform coverage. A preferred minimal coating coverage is at least 0.5 g/m$^2$. Preferred coating coverages of the film-forming binder are less than 2.0 g/m$^2$.

The following optional conventional components can be located in the Overcoat Unit and/or the Surface Coating:

A preferred auxiliary component is poly(silicic acid), typically represented by the formula:

(IV)

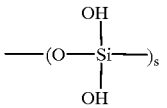

wherein s is an integer sufficient to provide a coatable aqueous solution of poly(silicic acid), such as an integer within the range of from at least 3 to about 600. The poly(silicic acid) can be incorporated by any conventional technique. A preferred technique is to incorporate tetraethyl ortho silicate, which then hydrolyzes in situ to form the poly(silicic acid). The barrier function of the iprotective coat overlying the imaging layer(s) is enhanced by the presence of the polysilicic acid. When relied upon to perform a barrier function, the poly (silicic acid) preferably accounts for from 50 to 90 weight percent of the total weight of the protective coat.

The poly(silicic acid) and film-forming binder teachings of Przezdziecki U.S. Pat. Nos. 4,741,992, 4,828,971 and 4,886,739, here incorporated by reference, are specifically contemplated for the protective coat constructions satisfying the requirements of this invention.

Matting agents are contemplated for optional inclusion in the Overcoat Unit and/or Surface Layer. Any of the matting agents disclosed in *Research Disclosure* Item 17029, XI. Overcoat layers; Przezdziecki U.S. Pat. No. 4,828,971; Mack et al U.S. Pat. No. 5,198,406; Melpolder et al U.S. Pat. No. 5,547,821; Kub U.S. Pat. No. 5,468,603; and Bjork et al U.S. Pat. No. 5,578,548, here incorporated by reference, can be employed. Although matting agents are surface modifiers, they are recognized to be effective when coated either in a surface coating or in an underlying interlayer.

Conventional conductivity increasing (antistatic) addenda are also contemplated for inclusion in the Overcoat Unit. Exemplary antistatic addenda and their preferred coating locations are taught by Markin et al U.S. Pat. No. 5,310,640 and Melpolder et al U.S. Pat. No. 5,547,821, here incorporated by reference.

Conventional coating aids (other than surfactants), such as described in *Research Disclosure*, Item 17029, X. Coating Aids, are contemplated for inclusion in the Overcoat Unit. All conventional choices of surfactants and coating aids are contemplated for inclusion in the remaining layers of the thermally processable elements.

The Imaging Layer Unit contains (a) a photosensitive silver halide (required only for photothermographic use), (b) a non-photosensitive organic silver salt capable of releasing silver ion, (c) a reducing agent for silver ion, and (d) a binder.

Each of these components are conventional and can take any of the forms disclosed in Grant U.S. Pat. No. 3,080,254; Przezdziecki U.S. Pat. Nos. 4,741,992, 4,828,971 and 4,886,739; Mack et al U.S. Pat. No. 5,198,640; Markin et al U.S. Pat. No. 5,310,640; Kub U.S. Pat. No. 5,468,603 and Bjork et al U.S. Pat. No. 5,578,548, here incorporated by reference.

The photosensitive silver halide can take any conventional form known to be useful in photothermography. Most commonly the silver halide is a high (>50 mole %, based on Ag) bromide silver halide, such as silver bromide or silver iodobromide. Advantages have been recently demonstrated to flow from employing high (>50 mole %) chloride {100} tabular grain silver halide emulsions in photothermographic elements by Levy et al U.S. Ser. No. 08/740,110, filed Oct. 28, 1996, titled A PHOTOTHERMOGRAPHIC ELEMENT FOR PROVIDING A VIEWABLE RETAINED IMAGE, now allowed, commonly assigned and here incorporated by reference (UK Patent 2,318,645 corresponding).

The photosensitive silver halide can be employed in any conventional level within the photothermographic layer. As disclosed by Hanzalik et al U.S. Pat. No. 5,415,993, the silver halide can be present in a concentration as low as 0.01 percent by weight, based on the total weight of the photothermographic layer. It is preferred that the silver halide grains be present in a concentration of at least 5 and, optimally, at least 10 percent by weight, based on the total weight of the photothermographic layer. Silver halide grain concentrations of up to 35 percent by weight or higher, based on the total weight of the photothermographic layer are contemplated, but, for most imaging applications, it is preferred that the silver halide grains be present in concentrations of less than 25 (optimally less than 10) percent by weight, based on the total weight of the photothermographic layer.

To increase its sensitivity, the photosensitive silver halide is chemically sensitized. Conventional chemical sensitizers, such as chalcogen (e.g., sulfur and/or selenium), noble metal (e.g., gold) and reduction sensitizers, are summarized in *Research Disclosure*, Vol. 389, September 1996, Item 38957, IV. Chemical sensitization.

When the silver halide is intended to record exposures outside its region of native sensitivity (the near ultraviolet and, for some compositions, shorter blue wavelengths), it is conventional practice to adsorb one or more spectral sensitizing dyes to the surfaces of the silver halide grains. Useful spectral sensitizing dyes are summarized in *Research Disclosure*, Item 38957, V. Spectral sensitization and desensitization, A. Sensitizing dyes.

The non-photosensitive organic silver salt is chosen for its capability of releasing silver ions. The organic silver salt is a silver salt which is comparatively stable to light, but forms a silver image when heated to 80° C. or higher in the presence of an exposed photocatalyst (i.e., the photosensitive silver halide) and a reducing agent. In the absence of a photocatalyst, the imagewise application of heat, albeit at somewhat higher temperatures, releases the silver ions. Silver salts of organic acids, particularly silver salts of long chain fatty carboxylic acids, are preferred. The carboxylic acids preferably contain an aliphatic hydrocarbon group of from 10 to 30, preferably 15 to 28 carbon atoms. Complexes of organic or inorganic silver salts, wherein the ligand has a gross stability constant for silver ion of between 4.0 and 10.0, are also useful in this invention. The source of reducible silver material generally constitutes from 20 to 70 percent by weight of the photothermographic layer. It is preferably present at a level of 30 to 55 percent by weight of the photothermographic layer. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts of aromatic carboxylic acids are also contemplated. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S Pat. No. 3,785,830. It is also contemplated to employ a silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, thiazole, imidazoline, imidazole, diazole, pyridine and triazine. Preferred examples of these heterocyclic compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethyl-glycolamido)-benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)-4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzothiazole and a derivative thereof as described in Japanese patent publications 30270/69 and 18146/70, for example a silver salt of benzotriazole such as silver salt of methylbenzotriazole, etc., a silver salt of a halogen substituted benzotriazole, such as a silver salt of 5-chlorobenzotriazole, etc., a silver salt of 1,2,4-triazole, of 1H-tetrazole as described in U.S Pat. No. 4,220,709, a silver salt of imidazole and an imidazole derivative, and the like.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used.

The method used for making silver soap dispersions is well known in the art and is disclosed in *Research Disclosure* October 1983 (23419) and U.S. Pat. No. 3,985,565.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

The reducing agent for the organic silver salt may be any material, preferably organic material, that can reduce silver ion to metallic silver. Conventional photographic developers such as 3-pyrazolidinones, hydroquinones, and catechol are useful, but hindered phenol reducing agents are preferred. The reducing agent is preferably present in a concentration ranging from 5 to 25 percent of the imaging layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis(ethoxyethyl)hydroxylamine,piperidinohexose reductone or formyl-4-methylphenylhydrazine, hydroxamic acids such as phenylhydroxamic acid, p-hydroxyphenylhydroxamic acid, and o-alaninehydroxamic acid; a combination of azines and sulfonamidophenols, e.g., phenothiazine and 2,6-dichloro-4-benzenesulfonamidophenol; (α-cyano-phenylacetic acid derivatives such as ethyl (α-cyano-2-methylphenylacetate, ethyl α-cyano-phenylacetate; bis-o-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydropiperidone-hexose reductone; sulfamidophenol reducing agents such as 2,6-dichloro-4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bis-phenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbylpalmitate, ascorbylstearate and unsaturated aldehydes and ketones, such as benzyl and diacetyl; 3-pyrazolidones; and certain indane-1,3-diones.

Any conventional binder can be employed in the Imaging Layer Unit. Any of the hydrophilic binders useful in the protective coat are also useful in the Imaging Layer Unit. Also contemplated for use as binders are synthetic resins such as polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred binders are poly(vinyl butyral), butylethyl cellulose, methacrylate copolymers, maleic anhydride ester copolymers, polystyrene, and butadiene-styrene copolymers.

It is specifically contemplated to employ organo-gel binders of the type disclosed by Hanzalik et al U.S. Pat. No. 5,415,993, the disclosure of which is here incorporated by reference.

The Imaging Layer Unit binders are employed in any convenient concentration for dispersing the components contained therein. Typically a preferred ratio of the binder to the light-insensitive, reducible silver source ranges from 15:1 to 1:2, most typically from 8:1 to 1:1. Since the binder and the light-insensitive, reducible silver source constitute the two highest concentration components of the imaging layer, it is preferred that these materials be chosen for maximum compatibility with this component. For example, whereas the light-insensitive, reducible silver source is a relatively hydrophilic material, such silver salts of compounds containing mercapto or thione groups, a hydrophilic colloid binder is favored, whereas, when the light-insensitive, reducible silver source is a more hydrophobic material, such as a silver soap or half soap—e.g., silver behenate, a synthetic resin binder, such as a vinyl acetal polymer or copolymer, is preferred.

In addition to the essential components of the formulation described above, it is appreciated that various optional components can additionally be present. In forming viewable silver images tone modifiers, such as those illustrated by *Research Disclosure*, Item 17029, cited above, V. Tone Modifiers, are particularly important to modifying silver particle formation during development and hence providing a more uniform and pleasing image tone.

Examples of toners include phthalimide and N-hydroxyphthalimide; cyclic imides such as succinimide, pyrazoline-5-ones and a quinazolinone 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, e.g., (N-dimethylaminomethyl)-phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylene-bis(1-carbamoyl-3,5-dimethylpyrazole), 1,8-(3,6-diazaoctane)bis(isothiuronium) trifluoroacetate and 2-(tribromomethylsulfonyl benzothiazole); and merocyanine dyes such as 3-ethyl-5[(3-ethyl-2-benzothiazolinylidene)-1 -methyl-ethylidene]-2-thio-2,4-o-azolidinedione; phthalazine and phthalazine derivatives; 1-(2H)-phthalazinone and 1-(2H)-phthalazinone derivatives or metal salts of these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus phthalic acid derivatives, e.g., phthalic acid, 4-methylphthalic acid, 4-nitrophthalic acid, and tetrachlorophthalic anhydride; quinazolinedi ones, benzoxazine or naphthoxazine derivatives; rhodium complexes such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimides, 2-hydroxy-4-aminopyrimidine, and azauracil, and tetrazapentalene derivatives, e.g., 3,6-dimercapto- 1 ,4-diphenyl-1H,4H-2,3a,5,6a-tetrazapentalene, and 1 ,4-di(o-chlorophenyl)-3,6-dimercapto-1H,4H-2,3a,5,6a-tetrazapentalene.

The preferred concentrations of toners are in the range of from 0.01 (most preferably 0.1) to 10 percent by weight, based on the total weight of the photothermographic layer.

Antifoggants and stabilizers for the photosensitive silver halide grains are preferably incorporated in the photothermographic layer. A variety of base generating materials, commonly referred to as activators, are conventionally employed in photothermographic layers to improve development. In order to simplify the coating compositions, activation and stabilization can be combined. Addenda in these classes are illustrated by *Research Disclosure*, Item 17029, cited above, IV. Activators/Activator-Stabilizers/Stabilizers, A. Activators and Activator Precursors, B. Stabilizers and Stabilizer Precursors, and C. Activator/

Stabilizers and Activator/Stabilizer Precursors, and VIII. Antifoggants/Post-processing Print-Out Stabilizers.

Specifically preferred antifoggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent No. 623,448; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

When thermally processable elements according to the invention are employed to record medical radiographic images, any of the various forms of Elements A through F discussed above can be employed. In medical diagnostic practice, it is preferred that radiographic images be viewed on a light box. Light is transmitted to the viewer from a white translucent surface through that the image bearing element. To avoid visual fatigue and by established practice the radiographic element is preferably blue tinted. A preferred location for tinting dyes is in the Support, but any of the light transmitting layer can incorporate a tinting dye. A common practice to is to locate a base level of blue tinting dye in the Support and to adjust the level of tinting to its preferred final level for a particular application by incorporating a supplemental level of tinting dye in one or more of the transparent layers of the element. Preferably the tinting dye is not interposed between an exposing light source and the Imaging Layer Unit.

When thermally processable elements are employed to provide radiographic images for viewing, they are most commonly used to provide viewable copies of radiographic images that have been previously captured and stored in digital form in an electronic memory. Photodiodes or lasers are commonly employed as light sources for exposure. The copy provides the radiologist with an image that is visually similar to that provided by conventional radiographic elements used for image capture.

It is alternatively possible to employ thermally processable elements according to the invention for capture of X-radiation images. The photothermographic forms of Elements A through E can be employed for capturing X-radiation images. The X-radiation exposure can be at low (diagnostic) levels or higher levels used for radiation therapy. In X-radiation image capture, it is common practice to coat Imaging Layer Units on both major faces of the Support. These elements are commonly referred to as dual-coated elements. A typical dual-coated element construction is illustrated by the following:

| Element F |
|---|
| Front Surface Coating |
| Front Imaging Layer Unit |
| Support |
| Back Imaging Layer Unit |
| Back Surface Coating |

In Element F the Support is transparent and preferably blue tinted. The "Front" designation indicates a position between the Support and the source of X-radiation while the designation "Back" indicates a position that receives X-radiation after passing through the Support. Only one of the Surface Coatings is required, and one only one of the Surface coatings need satisfy the requirements of the invention. Since symmetrical (identical front and back) constructions are primarily used for dual-coated radiographic elements, it is preferred that the Front and Back Surface coatings be identical. However, asymmetrical constructions for the Front and Back Imaging, Layers Units have been employed to obtain differing front and back images, each optimized for a different anatomical feature of the patient being examined.

Dickerson and Paul U.S. Pat. No, 5,738,981, here incorporated by reference, illustrates a dual-coated format applied to elements intended to capture digitally stored radiographic images. The dual-coated elements of Dickerson and Paul are exposed by photodiodes or a laser from one side. Thus, it is apparent that Element F can be exposed from one side by light or from one side by X-radiation.

More typically, a dual-coated radiographic element is mounted for exposure between a pair of Front and Back Intensifying Screens, which are separated from the radiographic element before thermal processing. Each Intensifying Screen absorbs X-radiation, received in an image pattern, and emits light in a corresponding image pattern. The light emitted by the Front Screen imagewise exposes the Front Imaging Unit while the light emitted from the Back Screen imagewise exposes the Back Imaging Unit. Since the Support is transparent, a portion of the light emitted by the Front Intensifying Screen can also expose the Back Imaging Unit and a portion of the light emitted by the Back Intensifying Screen can also expose the Front Imaging Unit. These unwanted additional exposures, commonly referred to as crossover, reduce image sharpness.

A preferred dual-coated radiographic element construction that can reduce or eliminate light crossover is illustrated by the following assembly, illustrating both crossover reduction and the components described in the preceding paragraph:

| Element G + Screens |
|---|
| Front Intensifying Screen |
| Front Surface coating |
| Front Imaging Layer Unit |
| Crossover Control Layer |
| Support |
| Crossover Control Layer |
| Back Imaging Layer Unit |
| Back Surface coating |
| Back Intensifying Screen |

While only one Crossover Control Layer is required to control crossover, two such layers are usually employed to avoid element asymmetry, requiring control of front and back orientation during exposure to obtain replicable images.

With the components described above the Imaging Layer Units are capable of producing a silver image by reduction of the organic silver salt. It is possible to form a dye image by choosing the incorporated reducing agent from among color developing agents. For example, where the incorporated developing or reducing agent is a color developing agent, it can react with a dye-forming coupler to produce an azo dye image. Particularly useful color developing agents are the p-phenylenediamines and especially the N-N-dialkyl-p-phenylenediamines in which the alkyl groups or the aromatic nucleus can be substituted or unsubstituted. Common p-phenylenediamine color developing agents are N-N-diethyl-p-phenylenediamine monohydrochloride, 4-N, N-diethyl-2-methylphenyl-enediamine monohydrochloride, 4-(N-ethyl-N-2-methanesulfonylaminoethyl)-2-methylphenylenediamine sesquisulfate monohydrate, and 4-(N-ethyl-N-2-hydroxyethyl)-2-methylphenylenediamine sulfate. Other p-phenylenediamines, similar compounds, and their use include those described in Nakamura et al U.S. Pat. No. 5,427,897, Mihayashi et al U.S. Pat. No. 5,380,625, Haijima et al U.S. Pat. No. 5,328,812, Taniguchi et al U.S. Pat. No. 5,264,331, Kuse et al U.S. Pat. No. 5,202,229, Mikoshiba et al U.S. Pat. No. 5,223,380, Nakamuara et al U.S. Pat. No. 5,176,987, Yoshizawa et al U.S. Pat. No. 5,006,437, Nakamuara U.S. Pat. No. 5,102,778 and Nakagawa et al U.S. Pat. No. 5,043,254. Dye-forming couplers useful with color developing agents are illustrated by *Research Disclosure*, Item 38957, X. Dye image formers and modifiers, B. Image-dye-forming couplers.

Leuco dyes are another class of reducing agents that form a dye image upon oxidation. The leuco dye can be any colorless or slightly colored compound that can be oxidized to a colored form, when heated, preferably to a temperature of from about 80 to 250° C. for a duration of from 0.5 to 300 seconds. Any leuco dye capable of being oxidized by silver ion to form a visible image can be used.

Representative classes of leuco dyes that are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. Preferred classes of dyes are described in U.S. Pat. No. 4,460,681 and 4,594,307.

One class of leuco dyes useful in this invention are those derived from imidazole dyes. Imidazole leuco dyes are described in U.S. Pat. No. 3,985,565.

Another class of leuco dyes useful in this invention are those derived from so-called "chromogenic dyes". These dyes are prepared by oxidative coupling of a p-phenylenediamine with a phenolic or anilinic compound. Leuco dyes of this class are described in U.S. Pat. No. 4,594,307.

A third class of dyes useful in this invention are "aldazine" and "ketazine" dyes. Dyes of this type or described in U.S. Pat. Nos. 4,587,211 and 4,795,697.

Another preferred class of leuco dyes are reduced forms of dyes having a diazine, oxazine, or thiazine nucleus. Leuco dyes of this type can be prepared by reduction and acylation of the color-bearing dye form. Methods of preparing leuco dyes of this type ore described in Japanese Patent 52-89131 and U.S. Pat. Nos. 2,784,186; 4,439,280; 4,563,415; 4,570,171; 4,622,395 and 4,647,525, all of which are incorporated hereby by reference.

Other illustrations of color materials are set out in *Research Disclosure*, Item No. 17029, cited above, XV. Color materials. Various conventional components that are employed in combination with dye image formers can additionally be present in the photothermographic layer. Such components include those set out in *Research Disclosure*, Item No. 38957, cited above, X. Dye image modifiers and addenda, C. Image dye modifiers, D. Hue modifiers/stabilization, and E. Dispersing dyes and dye precursors. Dye image stabilizers, such as those set out in paragraph (3) of section D, are particularly preferred components.

In each of Elements A through G described above each of the Imaging Layer Units can consist of a single layer in its simplest form. It is recognized that imaging advantages can be realized by dividing an Imaging Layer Unit into two or more layers in photothermographic applications. For example, it is generally appreciated that dividing a photothermographic Imaging Layer Unit into a faster imaging layer located to first receive exposing radiation and a slower imaging layer can increase imaging speed without a proportionate increase in granularity as compared to a single layer containing the same total ingredients.

When Elements A through E are employed for recording the natural colors of photographic subjects, the Imaging Layer Unit is contemplated to be divided into blue, green and red recording layers. For example, when the Imaging Layer Unit of Element B above is constructed in this manner, the following resulting element represents a preferred construction:

| Element H |
|---|
| Overcoat Unit |
| Blue Recording Layer |
| First Interlayer |
| Green Recording Layer |
| Second Interlayer |
| Red Recording Layer |
| Support |
| Surface Coating |

Each of the Blue, Green and Red Recording Layers can be divided, if desired, into faster and slower layers, as noted above. The Recording Layer order in Element H is that most commonly employed in photothermographic elements employing a silver halide that possesses native blue sensitivity. This layer order arrangement allows a blue light absorber, such as Carey Lea silver or a yellow dye, to intercept blue light passing through the Blue Recording Layer before it reaches the Green and Red Recording Layers. Silver halides that possess little or no native blue light sensitivity, such as those lacking silver iodide as a component and particularly high (>50 mole % based on Ag) chloride silver halides, allow the First Interlayer blue light absorber to be omitted with little or no performance penalty and allow the Blue, Green and Red Recording Layers to be coated in any desired sequence.

The First and Second Interlayers preferably employ a binder similar to that of the contiguous photothermographic layers and, if required by the dye image formers chosen, additionally contain an antistain agent (e.g., oxidized developing agent scavenger) to minimize color contamination by migrating reactants. Antistain agents are illustrated by *Research Disclosure*, Item 38957, cited above, X. Dye image formers and modifiers, D. Hue modifiers/stabilization, paragraph (2).

Although the Blue, Green and Red Recording Layers are constructed to produce yellow, magenta and cyan dye images when used for printing, it is recognized that it is now well recognized that, where the dye image information is intended to be retrieved by scanning, the dye images can be of any three distinguishable hues. Further, principal dye absorptions are not limited to the visible spectrum. The peak dye absorptions can occur in any three distinguishable locations ranging from the near ultraviolet to the near infrared.

The Supports of Elements A–H take any convenient conventional form employed in thermally processable elements. Supports are chosen for transparency or reflectance, as noted above. They are required to exhibit dimensional stability, to withstand elevated processing temperatures, to form an adhesive bond to coatings that contact them directly, and to be chemically compatible with the layers they receive as coatings, particularly the imaging layer. *Research Disclosure*, Item 17029, XVII. Supports summarizes conventional paper and film supports. Film support compositions elaborated are only those required to satisfy the more stringent thermal processing requirements. For the less stringent conventional thermal processing requirements, conventional film supports of the type also employed in aqueous processed radiographic elements are contemplated. These supports are summarized in *Research Disclosure*, Vol. 184, August 1979, Item 18431, XII. Film Supports. Also thermally stable film supports can be selected from among those conventionally employed for aqueous processed photographic elements, as illustrated in *Research Disclosure*, Item 38957, XV. Supports.

In photothermographic use, the photothermographic elements of the invention can be exposed to any type of radiation to which the silver halide grains are responsive—that is, which is capable of forming a developable latent image. These various forms of radiation are summarized in *Research Disclosure*, Item 38957, XVI. Exposure. Visible light, electromagnetic radiation of wavelengths conveniently emitted by photodiodes and lasers (including the visible spectrum and the near infrared), and X-radiation exposures are particularly contemplated.

Following imagewise exposure the photothermographic elements of the invention are uniformly heated to temperatures ranging from about 80 to 240° C., most typically between about 100 and 200° C. Placing the photothermographic element on a heated carrier or passing the photothermographic element between heated rollers are commonly practiced heating techniques. The optimum processing temperature is chosen to strike a balance against the physical thermal stresses inherent at the higher temperature levels and the faster thermal processing times that these higher temperature levels permit.

When the elements of the invention are employed as thermographic elements the photosensitive components (e.g., silver halide) are preferably absent. An internal image is created by transmitting imagewise applied heat, such as from a laser beam or a stylus, to the Imaging Layer Unit(s). The same temperature ranges are useful in photothermographic and thermographic imaging.

Immediately following thermal processing the incorporated image is available for viewing, printing, scanning or further manipulation, depending upon the specific imaging use intended.

EXAMPLES

The invention can be better appreciated by reference to the following specific embodiments and comparisons. All percentages are weight percentages based on total weight, unless otherwise indicated. The symbol ϕ is used to indicate phenylene (—$C_6$H4—).

Surfactant Key

Class 1 Surfactants

F(I)/E1 Triton X-200™, available from Union Carbide p-$C_8H_{17}$-ϕ-O—$(CH_2CH_2O)_2$—$CH_2CH_2SO_3^-Na^+$ F(I)/E2 Alkanol XC™, available from Dupont a mixture of $(C_3H_7)_3$—$C_{10}H_4$—$SO_3^-Na^+$ and $(C_3H_7)_2$—$C_{10}H_5$—$SO_3^-Na^+$ F(I)/E3 Hostapal BV™, available from Clariant Co.

2,4,6—$(C_4H_9)_3$-ϕ-O$(CH_2CH_2O)_nSO_3^-Na^+$ n is approximately 6

Class 2 Surfactants

C-2/C4 Tergitol TMN-10™, available from Union Carbide $C_{12}H_{25}(CH_2CH_2O)_nH$ $C_{12}H_{25}$ is a branched chain; n is approximately 11 fails to satisfy formula (II) by lacking an aromatic moiety

C-2/C5 APG 325CS™, available from Henkel the glucoside A–B

A=$C_nH_{2n+1}$, where n is 9 to 11

B=1 to 4 carbohydrate ($C_6H_{12}O_6$) units

F(II)/E6 Olin 10G™, available from Olin Corp.

a mixture of p-$C_9H_{19}$-ϕ-O—$[CH_2CH(CH_2OH)O]_m$—H and p-$C_9H_{19}$ϕ-O—$[CH_2CH(OH)CH_2O]_m$—H m=a mixture of 3 tol6 integers (II)/E7 Triton X-100™, available from Union Carbide p-$CH_3$—$C(CH_3)_2CH_2C(CH_3)_2$-ϕ-O$(CH_2CH_2O)_x$—H x=a mixture of 9 and 10 integers Class 3 Surfactants C-3/C8 Fluorotenside FT-248™, available from Bayer, A. G.

tetraethylammonium perfluorooctylsulfonate;

fails to satisfy formula (III) by lacking an alkoxy group

C-3/C9 Lodyne S-100™, available from Ciba-Geigy a mixture of $R^f(CH_2)_2SCH(CO_2H)CH_2CONH(CH_2)_3N(CH_3)_2$ and $R^f(CH_2)_2SCH(CH_2CO_2H)CONH(CH_2)_3N(CH_3)_2$ where $R^f$ is a mixture of $C_6F_{13}$, $C_8F_{17}$ and $C_{10}F_{21}$ fails to satisfy formula (III) by lacking an alkoxy group F(III)/E10 Fluorad FC-170C™, available from 3M $C_8F_{17}SO_2N(C_2H_5)(CH_2CH_2O)_nH$ n is approximately 8

F(III)/E11 Zonyl FSN™, available from DuPont perfluoroalkylpolyoxyethylene alcohol

Listing of Other Condensed Names

CP Chlorowax™, a chlorinated parafin, available from Oxy-Chem

M-1 1.5 μm mean size poly(methyl methacrylate) matte particles

PDMS General Electric SF-96-200™, poly (dimethylsiloxane)

PSA Poly(silicic acid), prepared by hydrolyzing tetraethoxy orthosilicate

ODTS Octadecyltrimethoxysilane

PVA Elvanol 52-22™, poly(vinyl alcohol), available from DuPont, 86–89% hydrolyzed PVB Butvar 76™, poly(vinyl butyral), molecular weight 90,000–120,000, available from Monsanto CA-1 Dowanol™, the coating aid 2-phenoxyethanol, available from Dow Chemical Co.

SS-1 The spectral sensitizing dye anhydro-3-ethyl-9,11-neopentylene-3'-(3-sulfopropyl)thiadicarbocyanine hydroxide AD-1 Copper phthalocyanine acutane dye

Example 1

A thermally processable imaging element was prepared by coating a blue (0.14 density) poly(ethylene terephthalate) support, having a thickness of 0.178 mm, with a photothermographic imaging layer and a protective coat. The photothermographic imaging composition was coated from a solvent mixture containing 74.5% 2-butanone, 10.0% toluene, 15% methanol and 0.5% CA-1 at a wet coverage of 75.3 g/m$^2$ to form an imaging layer of the following dry composition:

| Imaging Layer | |
|---|---|
| Components | Dry Coverage (g/m$^2$) |
| Succinimide | 0.258 |
| Phthalimide | 0.323 |
| PDMS | 0.006 |
| 2-bromo-2-((4-methylphenyl)sulfonyl)acetamide | 0.102 |
| Naphthyl triazine | 0.025 |
| Palmitic acid | 0.124 |
| N-(4-hydroxyphenyl)-benzenesulfonamide | 2.519 |
| Silver, as silver bromide | 0.310 |
| SS-1 | 0.005 |
| Silver, as silver behenate | 1.882 |
| Polyvinyl butyral, M.W. 90,000–120,000 (Monsanto Butvar B-76, 11–13% hydroxyl content) | 7.058 |
| Mercury, as mercuric bromide | 0.001 |
| CP | 0.700 |
| AD-1 | 0.001 |
| Trimethyl borate | 0.167 |

The resulting imaging layer was subsequently overcoated with a mixture of polyvinyl alcohol and hydrolyzed tetraethyl orthosilicate, TEOS, (forming polysilicic acid, PSA) at a wet coverage of 40.4 g/m$^2$ along with other components. The polysilicic acid was prepared by mixing 30.39 weight percent water, 0.23% 1 N p-toluenesulfonic acid, 34.01% methanol and 35.37% tetraethoxysilane to form a 16.32% polysilicic acid solution. The coating coverage of the PSA and other components in the dried protective coating are indicated below.

| Protective Coat | |
|---|---|
| Component | Dry Coverage (g/m$^2$) |
| PSA | 1.2906 |
| PVA | 0.8633 |
| Surfactants varied in composition and amount as indicated in TABLE I | |
| Aniline Blue tinting dye | 0.0026 |
| M-1 | 0.0161 |

Using this common formulation a series of samples were prepared. After coating and drying, all samples were wound, cut, thermally processed to 1.2 to 1.3 neutral density, and visually inspected for minus density spot imperfections with 7× magnification. The surfactants and concentrations in each element, as well as the counts of three sizes of minus density spots per 310 cm$^2$ in their respective coated samples are shown in Table I. The three size categories indicated in the table represent average spot diameter reported in mm. Minus density spots of any size are undesirable.

TABLE I

| | Class 1 | Class 2 | Class 3 | | Spot Counts | | |
|---|---|---|---|---|---|---|---|
| Sample | Surfactant (g/m$^2$) | Surfactant 2 (g/m$^2$) | Surfactant (g/m$^2$) | ODTS | 2 mm + | 1 mm to 2 mm | <1 mm |
| A | | (0.0323)E6 | (0.0108)C8 (0.0006)C9 | no | 0 | 0 | >100 |
| B | | (0.0323)E6 | (0.0108)C8 (0.0431)E11 | no | 0 | 0 | >100 |
| C | (0.0807)E1 | (0.0323)E6 | (0.0108)C8 | no | 0 | 6 | 36 |
| D | | (0.0323)E6 | (0.0006)C9 | no | 0 | 0 | >100 |
| E | (0.0807)E1 | | (0.0006)C9 (0.0108)C8 | no | 11 | 22 | 36 |
| F | | (0.0807)E7 | (0.0006)C9 (0.0108)C8 | no | 0 | 0 | >100 |
| G | | (0.0807)C4 | (0.0006)C9 (0.0108)C8 | no | 0 | 0 | 74 |
| H | | (0.0323)E6 | (0.0006)C9 | yes | 0 | 0 | >100 |
| J | | (0.0323)E6 | (0.0431)E11 | yes | 0 | 1 | >100 |
| K | (0.0807)E1 | (0.0323)E6 | (0.0006)C9 | yes | 0 | 28 | >100 |
| L | (0.0807)E1 | (0.0323)E6 | (0.0431)E11 | yes | 0 | 0 | 0 |

Samples A through K were considered to be failures to varying degrees. Sample L, which demonstrated no visible lower density spots, was formulated in accordance with the requirements of the invention.

Example 2

The formulations of this example were prepared similarly as those of Example 1, except that PSA was prepared with ethanol replacing methanol on a one for one basis. The results are summarized in Table II.

TABLE II

| Sample | Class 1 Surfactant ($g/m^2$) | Class 2 Surfactant 2 ($g/m^2$) | Class 3 Surfactant ($g/m^2$) | ODTS | Spot Counts 2 mm + | 1 mm to 2 mm | <1 mm |
|---|---|---|---|---|---|---|---|
| M | | (0.0323)E6 | (0.0108)C8 (0.0006)C9 | no | 1 | 0 | >100 |
| N | (0.0807)E1 | | (0.0215)C8 (0.0006)C9 | no | 7 | 37 | 79 |
| O | (0.1211)E1 | | (0.0215)C8 (0.0006)C9 | no | 18 | 37 | 84 |
| P | | (0.0323)E6 | (0.0006)C9 (0.0108)E10 | no | 0 | 0 | 89 |
| Q | | | (0.0108)E11 | no | 0 | 0 | >100 |
| R | | | (0.0431)E11 | no | 0 | 0 | >100 |
| S | (0.1211)E1 | | | no | 5 | 4 | 13 |
| T | (0.0807)E1 | | (0.0431)E11 | no | 0 | 0 | 19 |
| U | (0.0807)E1 | | (0.0431)E11 | yes | 3 | 1 | 19 |
| V | (0.1211)E1 | | (0.0054)E11 | no | 1 | 3 | 58 |
| W | (0.1211)E1 | | (0.0086)E11 | no | 2 | 0 | 41 |
| X | (0.1211)E1 | | (0.0215)E11 | no | 0 | 0 | 19 |
| Y | (0.1211)E1 | | (0.0215)E11 | yes | 0 | 0 | 17 |
| Z | (0.0807)E1 | | (0.0108)C8 (0.0108)E11 | no | 0 | 4 | >100 |
| AA | (0.0807)E1 | (0.0404)E6 | | no | 1 | 2 | 15 |
| BB | (0.1211)E1 | (0.0404)C5 | | no | 3 | 4 | >100 |
| CC | (0.0807)E1 | (0.0404)E6 | (0.0054)E11 | no | 0 | 0 | 7 |
| DD | (0.0807)E1 | (0.0404)E6 | (0.0108)E11 | no | 0 | 0 | 4 |
| EE | (0.0807)E1 | (0.0323)E6 | (0.0215)E11 | yes | 1 | 1 | 0 |
| FF | (0.0484)E1 | (0.0323)E6 | (0.0215)E11 | yes | 0 | 1 | 8 |
| GG | (0.0323)E1 | (0.0323)E6 | (0.0215)E11 | yes | 2 | 4 | 10 |
| HH | (0.0807)E3 | (0.0323)E6 | (0.0108)E11 | yes | 0 | 4 | 2 |
| JJ | (0.0484)E3 | (0.0323)E6 | (0.0108)E11 | yes | 1 | 3 | 2 |
| KK | (0.0323)E3 | (0.0323)E6 | (0.0108)E11 | yes | 0 | 2 | 0 |
| LL | (0.1211)E2 | (0.0323)E6 | (0.0108)E11 | yes | 0 | 11 | 2 |
| MM | (0.0807)E1 | (0.0323)E6 | (0.0108)E10 | yes | 0 | 4 | 2 |

Elements CC through MM satisfied the requirements of the invention. The remaining elements were deemed to have undesirable low density spot characteristics.

The invention has been described in detail with particular reference to certain preferred embodiments thereof, but it will be understood that variations and modifications can be effected within the spirit and scope of the invention.

What is claimed is:

1. A thermally processable imaging element, said element being comprised of a support;

at least one thermographic or photothermographic imaging layer coated on the support containing an organic silver salt capable of releasing silver ion and a thermally activated reducing agent for silver ion; and a protective coat overlying the imaging layer including a film-forming binder comprised of a water dispersible polymer containing hydroxy pendant groups;

WHEREIN, to reduce low density spots visible after thermal processing, a combination of the following surfactants are included in the protective coat:

(I) $(R^1)_z$—Ar—[O—$(R^2)_w$—(L) $_x]_y$—$X^-M^+$ (II) $(R^1)_z$—Ar—O—$(R^2)_v$—H and (III) $R^f$—$[SO_2N(R^3)]_t(R^2)_u$—H wherein $R^1$ is a saturated hydrocarbon containing from 1 to 20 carbon atoms;

z is 1 to 3;

Ar is a divalent aromatic group containing from 6 to 14 carbon atoms;

L is a divalent hydrocarbon linking group containing up to 5 carbon atoms;

x is zero or 1;

y is zero or 1;

$X^-$ is —$SO_3^{-1}$ or —$SO_4^{-1}$;

$M^+$ is an alkali metal or ammonium cation;

$R^2$ a divalent hydrophilic alkoxy group;

w is zero to 20;

v is 3 to 20;

u is 4 to 24;

t is zero or 1;

$R^3$ is hydrogen or an alkyl group of from 1 to 5 carbon atoms;

$R^f$ is a fluorocarbon group containing 4 to 24 carbon atoms;

compound (I) accounts for from 30 to 75 percent of the total weight of compounds (I), (II) and (III);

compound (II) accounts for from 15 to 50 percent of the total weight of compounds (I), (II) and (III);

compound (III) accounts for from 4 to 40 percent of the total weight of compounds (I), (II) and (III).

2. A thermally processable element according to claim 1 wherein the imaging layer additionally includes photosensitive silver halide.

3. A thermally processable element according to claim 1 wherein compound (I) accounts for from 40 to 65 percent of the total weight of compounds (I), (II) and (III).

4. A thermally processable element according to claim 1 wherein compound (II) accounts for from 20 to 35 percent of the total weight of compounds (I), (II) and (III).

5. A thermally processable element according to claim 1 wherein compound (III) accounts for from 10 to 30 percent of the total weight of compounds (I), (II) and (III).

6. A thermally processable element according to claim 1 wherein compound (I) is present in a concentration of from 0.5 to 10 percent by weight, based on the total weight of the protective coat.

7. A thermally processable element according to claim 6 wherein compound (I) is present in a concentration of from 1 to 6 percent by weight, based on the total weight of the protective coat.

8. A thermally processable element according to claim 1 wherein the organic silver salt is a silver salt of a carboxylic acid containing an aliphatic hydrocarbon chain of from 10 to 30 carbon atoms.

9. A thermally processable element according to claim 1 wherein the imaging layer contains a poly(vinyl acetal) binder.

10. A thermally processable imaging element comprised of a transparent film support;

at least one photothermographic imaging layer coated on the support containing an organic silver salt of a carboxylic acid containing an aliphatic hydrocarbon chain of from 15 to 28 carbon atoms capable of releasing silver ion, and a thermally activated reducing agent for silver ion; and a protective coat overlying the imaging layer including a film-forming binder comprised of poly(vinyl alcohol);

WHEREIN, to reduce low density spots visible after thermal processing, a combination of the following surfactants are included in the protective coat:

(I) $(R^1)_z$—Ar—O—$(R^2)_w$—$(L)_x$—$SO_3^{-1}M^+$ (II) $(R^1)_z$—Ar—O—$(R^2)_v$—H and (III) $R^f$—$[SO_2N(R^3)]_t(R^2)_u$—H wherein $R^1$ is a saturated hydrocarbon containing from 2 to 10 carbon atoms;

z is 1 to 3;

Ar is a divalent phenylene or naphthalene group;

L is a divalent hydrocarbon linking group containing up to 5 carbon atoms;

x is zero or 1;

$M^+$ is an alkali metal or ammonium cation;

$R^2$ a divalent hydrophilic alkoxy group;

w is 2 to 10;

v is 6 to 16;

u is 6 to 16;

t is zero or 1;

$R^3$ is hydrogen or an alkyl group of from 1 to 5 carbon atoms;

$R^f$ is a fluorocarbon group containing 6 to 16 carbon atoms;

compound (I) accounts for from 40 to 65 percent of the total weight of compounds (I), (II) and (III);

compound (II) accounts for from 20 to 35 percent of the total weight of compounds (I), (II) and (III);

compound (III) accounts for from 10 to 30 percent of the total weight of compounds (I), (II) and (III).

* * * * *